US005924733A

United States Patent [19]

Palleschi

[11] Patent Number: 5,924,733

[45] Date of Patent: Jul. 20, 1999

[54] IN-LINE SKATE GUARD

[76] Inventor: Michael Palleschi, #307 - 3680 W. 7th Ave., Vancouver, Canada, V6R 1W4

[21] Appl. No.: 08/749,940

[22] Filed: Nov. 14, 1996

Related U.S. Application Data

[63] Continuation-in-part of application No. 08/550,731, Oct. 31, 1995, abandoned.

[51] Int. Cl.[6] ..... A63C 3/12

[52] U.S. Cl. ..... 280/825

[58] Field of Search ..... 280/809, 811, 280/825, 7.14, 11.19, 11.2, 11.22, 11.23; 36/7.1 R, 7.3, 15, 100, 101, 115, 135, 132

[56] References Cited

U.S. PATENT DOCUMENTS

| | | | |
|---|---|---|---|
| 1,310,137 | 7/1919 | Sadowsky . | |
| 1,552,766 | 9/1925 | Sedgwick . | |
| 2,323,049 | 6/1943 | Johnson . | |
| 3,027,660 | 4/1962 | Werner . | |
| 3,861,697 | 1/1975 | Dolce | 280/11.1 |
| 5,183,292 | 2/1993 | Ragin . | |
| 5,236,224 | 8/1993 | Anderson et al. . | |
| 5,303,955 | 4/1994 | Zurnamer | 280/825 |
| 5,320,366 | 6/1994 | Shing . | |
| 5,445,415 | 8/1995 | Campbell . | |
| 5,503,433 | 4/1996 | Lachapelle . | |
| 5,522,621 | 6/1996 | Schneider . | |
| 5,573,275 | 11/1996 | Smith | 280/825 |

*Primary Examiner*—Robert J. Oberleitner
*Assistant Examiner*—C. T. Bartz
*Attorney, Agent, or Firm*—Oyen Wiggs Green & Mutala

[57] ABSTRACT

This invention relates to a novel in-line skate guard. A resilient in-line skate wheel stop comprising: (a) a wedge-like member which fits between bottom facing areas of adjacent wheels of an in-line skate, and frictionally prevents said adjacent wheels from rotating; and (b) a loop-like resilient suspension member which is attached to the wedge-like member and fits over a toe or heel area of a wheel mounting of an in-line skate.

14 Claims, 7 Drawing Sheets

FIG. 10
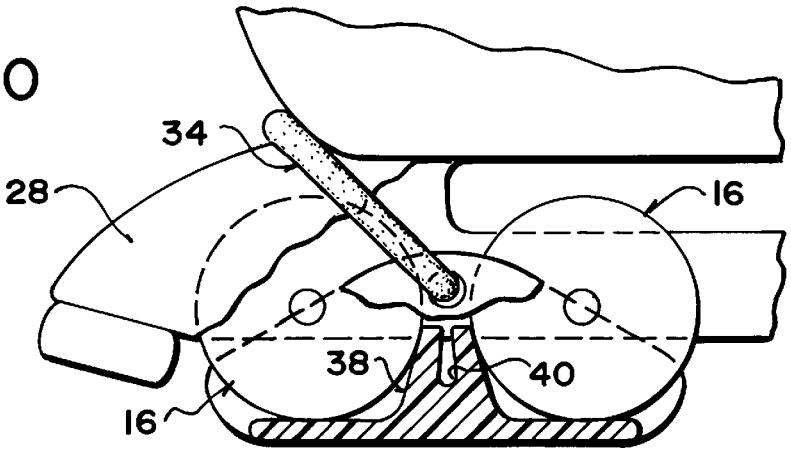
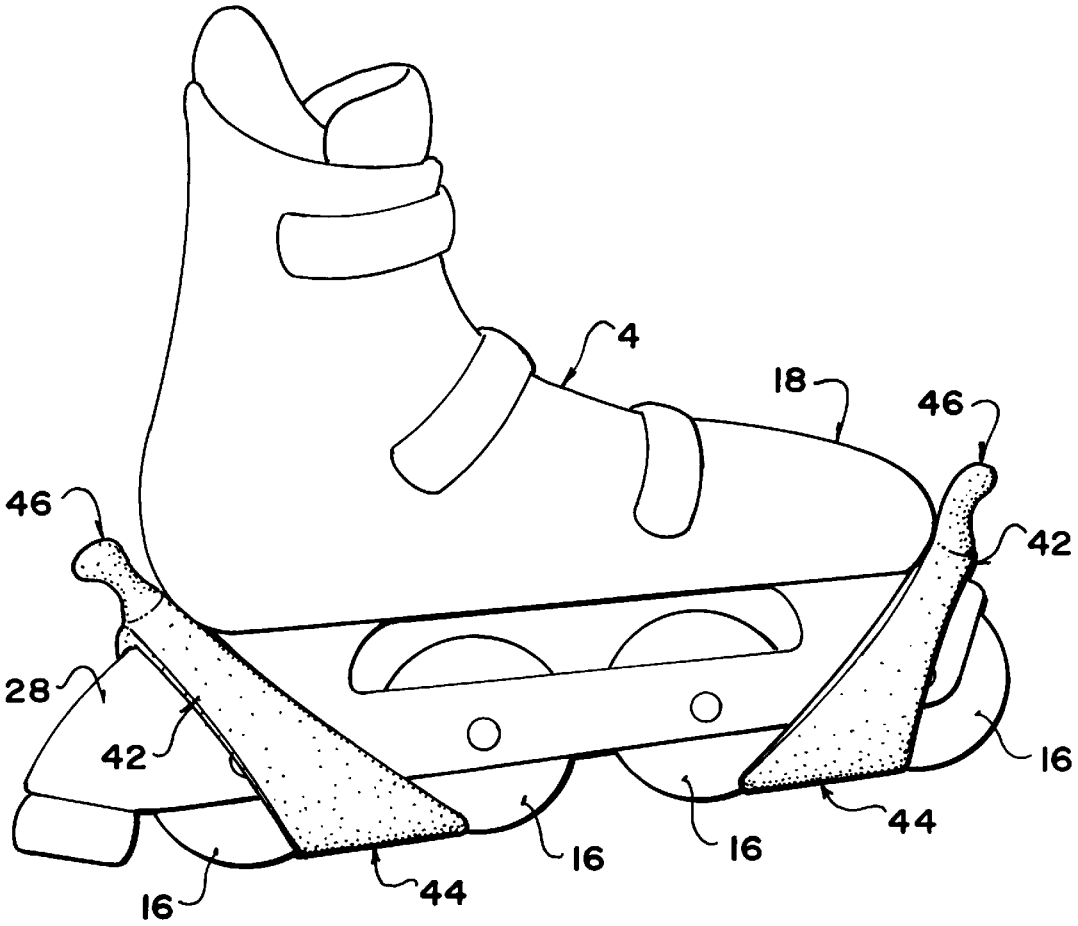
FIG. 11

IN-LINE SKATE GUARD

This application is a continuation-in-part of application Ser. No. 08/550,731, filed Oct. 31, 1995, now abandoned.

FIELD OF THE INVENTION

This invention relates to a novel in-line skate guard. More particularly, this invention pertains to a novel collapsible elastic web-like guard which can be stretched over the boot and wheels of an in-line skate to thereby immobilize the wheels of the skate and enable the skater to walk or climb while wearing the skates.

BACKGROUND OF THE INVENTION

In-line skates have become very popular as recreational and sports equipment during the past decade. Millions of in-line skates have been sold. In-line skates are usually equipped on the underside of a boot with four, or occasionally five, wheels which are in forward serial alignment with one another. The in-line skate is also usually equipped with a brake pad at the rear of the row of in-line wheels on one of the skates.

In-line skates typically have bearing mounted wheels which are made for easy rolling over the ground. As a consequence, because there is very little friction inhibiting forward or rearward movement it is often difficult for a skater to stand still on a pair of in-line skates, or stop from rolling forward on an incline, or climb stairs and hills without difficulty. Usually the skater must hold onto a stationary object, such as a hand rail, while climbing stairs, or a tree or post or some other stationary object while on an incline, in order to prevent the in-line skates from rolling forward or backward.

There has been a continuing longstanding need for an easy to use device which will prevent the wheels of an in-line skate from rotating when the skater does not want the wheels to rotate, such as when the skater wants to walk or climb. U.S. Pat. No. 5,236,224, Anderson et al., discloses a removable wheel cover for an in-line type skate. The cover includes a front boot designed to inwardly receive the skate's front wheel. The cover also includes a rear boot designed to inwardly receive the skate's rear wheel. A pair of flexible, resilient straps connect the two boots of the cover together. When not in use, the cover can be folded into a small volume and easily stored within a user's pocket.

A serious problem with the Anderson et al. removable wheel cover is that although the front boot portion 20 fits over a front wheel of an in-line skate, and the rear boot portion 22 fits over a rear wheel of the skate, there is nothing which prevents the skater from "skating out of" the removable wheel cover. The front boot portion of the Anderson et al. removable wheel cover is formed of flexible resilient straps. Thus the wheels can easily roll out of the guard when the skater places the skate and guard on the ground. The toe 14 of the front boot 20 of the in-line skate is not prevented from rolling forward out of the resilient removable wheel cover. There is also no mechanism in the Anderson et al. guard which prevents the middle wheels from rolling forward, and hence preventing the skater from skating out of the resilient removable wheel cover.

SUMMARY OF THE INVENTION

The invention is directed to a wheel stop having a boot with a toe area and a heel area, a wheel supporting carriage underneath a sole of the boot, for an in-line skate comprising: (a) an abutment member which fits between and abuts bottom facing areas of adjacent wheels of the in-line skate, and frictionally prevents said adjacent wheels from rotating; and (b) a tension member which associated with the abutment member and fits over a toe or heel area of the wheel carriage of the in-line skate, said tension member holding the abutment member against the bottom facing areas of the adjacent wheels, and applying an upward force on the adjacent wheels, thereby preventing said wheels from rotating.

The tension member can be made of resilient material and can be in the shape of an inverted "Y", and the abutment members can be a pair of wedge-like members that are connected to the ends of the forked stems of the inverted "Y", and a securing member can be attached to the base of the stem of the inverted "Y" and can be adapted to fit about an in-line skate and hold the pair of wedge-like members in position between adjacent wheels of the in-line skate.

The abutment member can be constructed with a pair of hollow trough-like depressions therein for accommodating a pair of adjacent wheels of the in-line skate, and a protruding wedge-like member can protrude upwardly and abut the lower facing surfaces of a pair of adjacent wheels of the in-line skate.

The tension member can be constructed in the form of a resilient loop for fitting over the forward or rearward portion of a carriage for wheels of an in-line skate. The wedge-like member can have a slot therein.

The wheel lock can include a finger grip member secured to the tension member for enabling a skater to grip the tension member.

The wheel stop can include a forward resilient loop for fitting over the toe portion of the wheel carriage, a second resilient loop for fitting over a rear heel portion of a wheel carriage of the in-line skate and four wheel abutment members which are adapted to fit over the bases of four wheels of the in-line skate and frictionally prevent the wheels from rotating.

The tension member can be in the form of a pocket-shaped membrane with a plurality of openings therein constructed of resilient material and shaped to be fittable over the boot and wheels of the in-line skate, and can include means for enabling a person to pull the pocket-shaped membrane over an in-line skate.

The number of openings in one area of the resilient membrane can be greater than in another area of the membrane. The resilient membrane can be constructed of a fabric.

The means for pulling the membrane over the skate can comprise an upper finger pull attached to one side of the pocket shaped membrane and a lower finger pull attached to the opposite side of the pocket-shaped membrane.

The membrane can be constructed of resilient rubber. The web can be constructed of an elastomer.

The pocket-shaped membrane, when in a stretched condition, can form a hollow envelope which can accommodate the arch, toe, wheels and heel areas of the in-line skate.

BRIEF DESCRIPTION OF THE DRAWINGS

In drawings which illustrate specific embodiments of the invention, but which should not be construed as restricting the spirit or scope of the invention in any way:

FIG. 2 illustrates a side view of an in-line skate guard initially being stretched over the toe of an in-line skate.

FIG. 3 illustrates a subsequent sequential side view of an in-line skate guard being stretched over the toe and rear wheels of an in-line skate.

FIG. 4 illustrates a final sequential side view of an in-line skate guard installed over the toe, wheels and heel of an in-line skate.

FIG. 10 illustrates a side partial section view of the wheel lock and heel loop of the in-line skate guard illustrated in FIG. 8.

FIG. 11 illustrates an isometric view of a fourth embodiment of elastic wheel lock loop which can be used on both the heel and toe of an in-line skate.

DETAILED DESCRIPTION OF SPECIFIC EMBODIMENTS OF THE INVENTION

Figure 1:
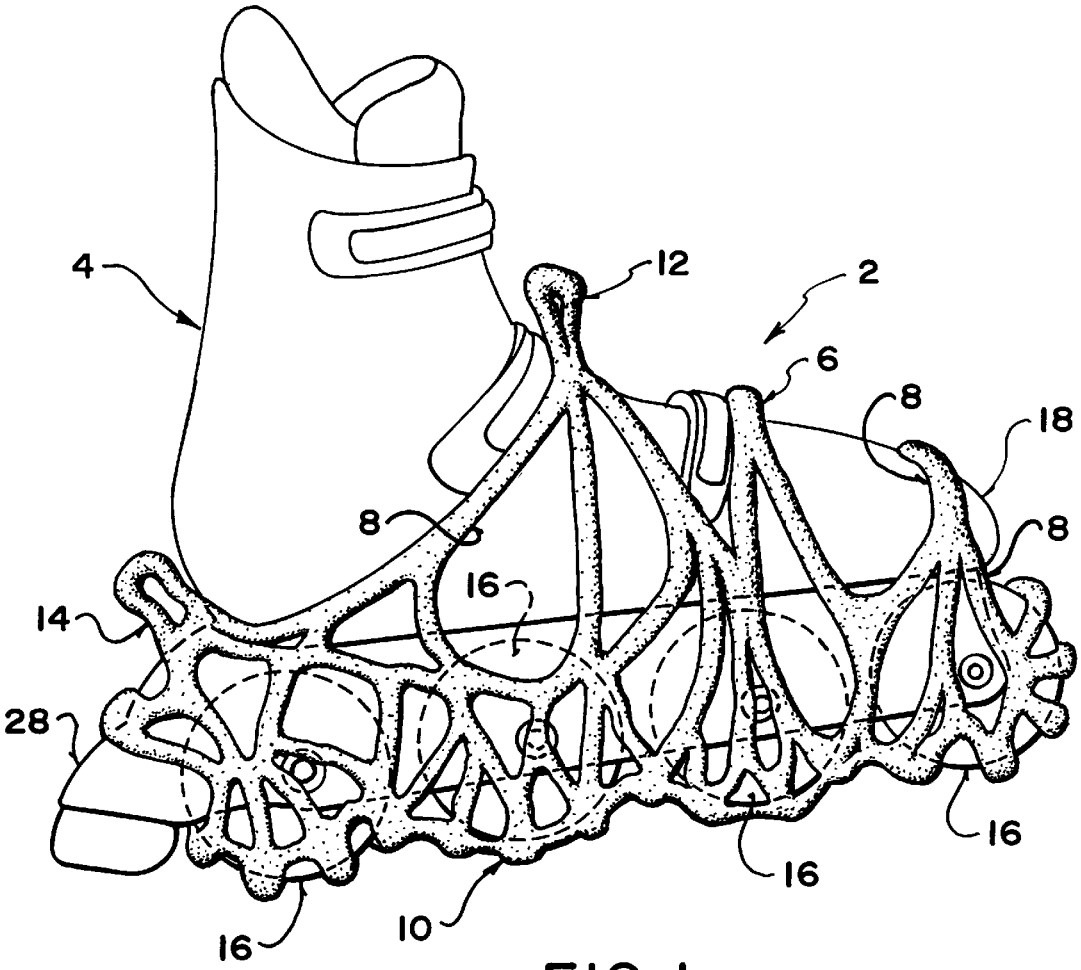
FIG. 1 illustrates an isometric view of an in-line skate guard installed on an-line skate.

Referring to the drawings, FIG. 1 illustrates an isometric view of an in-line skate guard installed on an in-line skate. Specifically, as seen in FIG. 1, the in-line skate guard 2 is installed over the ankle, toe, four wheels 16 and heel of an in-line skate 4. The in-line skate guard 2 is constructed of a fabric or web-like network of elastic material comprising a resilient stretchable web 6, with a plurality of openings 8 distributed throughout the elastic web 6. As seen in FIG. 1, the in-line skate guard 2 is constructed so that there is a dense web 10 area enclosing all four of the four wheels 16 of the base of the boot of the in-line skate 4. The web 6 is less dense over the toe and ankle areas of the in-line skate 4. Stated another way, the number of openings 8 is much higher, and the size of such openings 8 is much smaller, in the dense web 10 area of the in-line skate guard 2 compared to the toe and ankle areas of the web 6. In this way, the wheels of the in-line skate are securely gripped and immobilized by the dense web 10 area of the skate guard 2. None of the wheels 16 touch the ground when the web 6 is stretched over the toe, ankle and heel of the in-line skate 4. Thus the skate 4 cannot "roll out of the web 6".

As seen in FIG. 1, the guard 2, when stretched over the skate 4 assumes a triangular shape which creates a triangle of compensating forces. Any attempt to change this triangle of compensating forces is discouraged. Further, by fitting over the arch, toe and heel areas of the skate, it is not possible for the skate boot 4 to move out of the interior of the web 6.

FIG. 1 also illustrates an upper finger pull loop 12, and a lower finger pull loop 14, which are formed at the ankle area and heel area of the in-line skate guard 2 respectively. The upper finger pull loop 12 and the lower finger pull loop 14 are used to help the skater install the in-line skate guard 2 over an in-line skate 4 as will be explained below.

Figure 2:
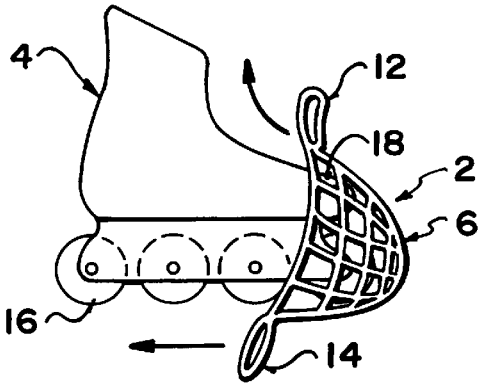
FIGS. 2, 3 and 4 illustrate successive side views of an in-line skate guard being installed on an in-line skate.
Figure 3:
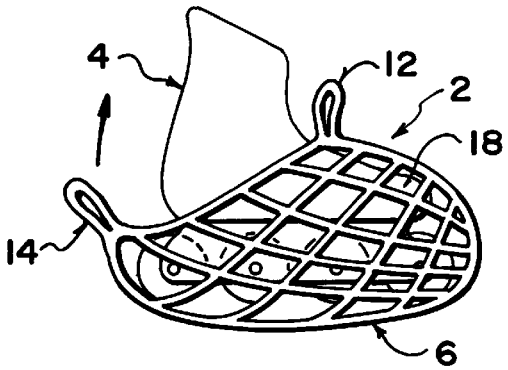
Figure 4:
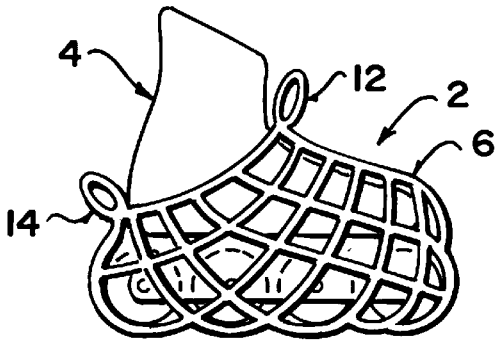

FIGS. 2, 3 and 4 illustrate successive side views of an in-line skate guard 2 being installed over an in-line skate 4. FIG. 2 illustrates a side view of an in-line skate guard initially being stretched over the toe 18 and front wheel 16 of an in-line skate 4. As indicated by the vertical arrow next to the upper finger pull loop 12 and the horizontal arrow adjacent the lower finger pull loop 14, the web 6 is initially pulled and stretched over the toe 18 and the front wheel 6 of the in-line skate 4.

FIG. 3 illustrates a subsequent sequential side view of an in-line skate guard 2 being stretched over the toe, arch, front and rear wheels of an in-line skate 4. As indicated by the vertical arrow adjacent lower finger pull 14 in FIG. 3, the web 6 of the skate guard 2 has been pulled over the toe 18, all four underlying wheels 16 and a portion of the heel of the in-line skate 4.

FIG. 4 illustrates a final sequential side view of an in-line skate guard 2 installed over the toe 18, four wheels 16 and heel of an in-line skate 4. Specifically, as seen in FIG. 4, the web 6 of the skate guard 2 has been pulled completely over the upper arch, the forward toe 18, all four underlying wheels 16 and the heel of the in-line skate 4. In this position, the skate guard 2 assumes a generally triangular shape with a triangular arrangement of compression forces which compensate one another and hold the guard 2 snugly on the skate 4. The fully stretched guard 2 immobilizes the wheels 16 and prevents the wheels 16 from rotating in either direction. The skater can therefore walk in the skates, climb up inclines without rolling backward, navigate downward slopes under full control, climb stairs, and deal with all types of situations where the skater can securely step without the wheels 16 rolling.

To remove the web 6 of the skate guard 2 from the in-line skate 4, the opposite procedure and sequence, as illustrated in FIGS. 2, 3 and 4, is followed. The removed guard 2 is small in size and can be put in a pocket, or carried in some other ways as explained below in association with FIGS. 5 and 6.

Figure 5:
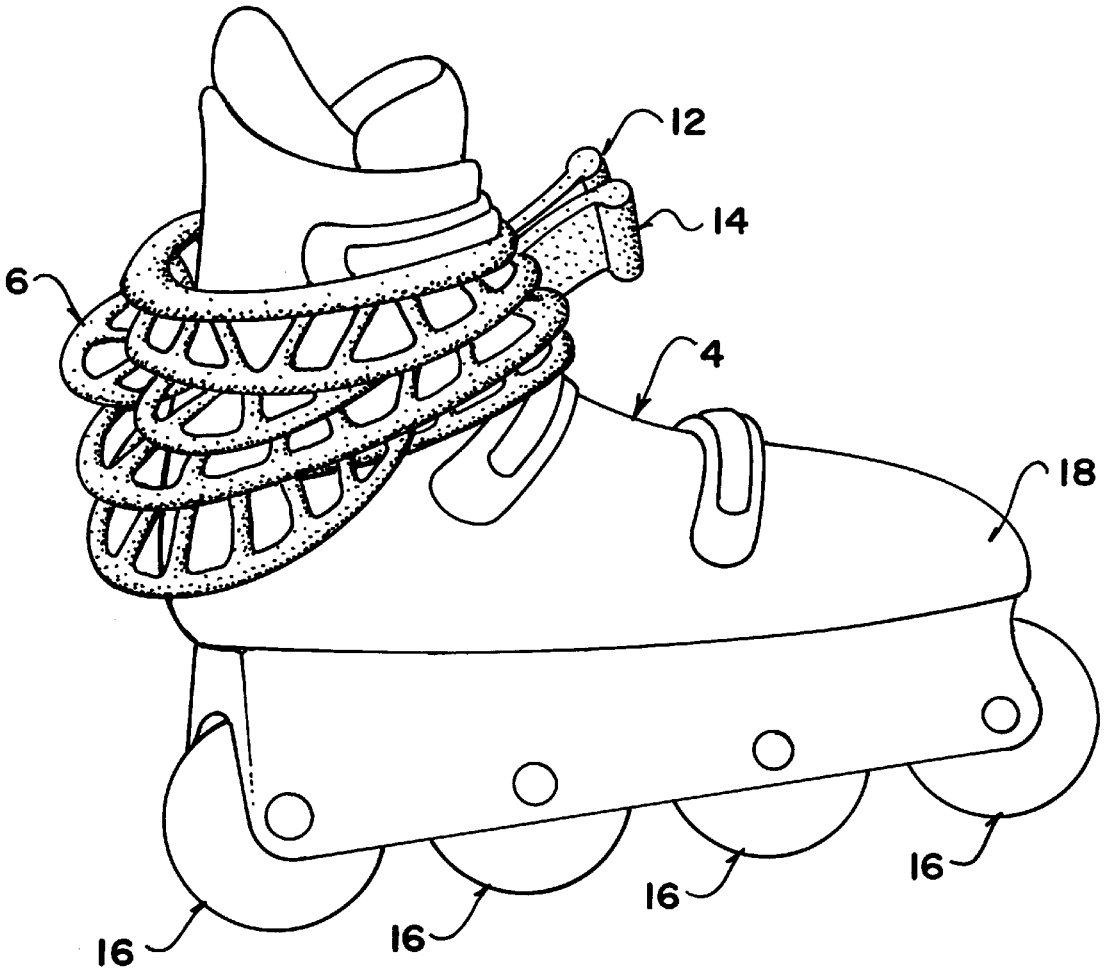
FIG. 5 illustrates an isometric side view of an in-line skate guard stretched around the ankle of an in-line skate, when the in-line skate guard is not in use to guard the wheels of the in-line skate.

FIG. 5 illustrates an isometric side view of an in-line skate guard 2 stretched around the ankle of an in-line skate 4, when not in use to guard and immobilize the wheels 16. As seen in FIG. 5, the in-line skate guard 2, by being constructed of a resilient material, such as rubber, can in its unstretched condition be slipped over the ankle area of an in-line skate 4. In this way, the in-line skate guard 2 can be comfortably worn by the skater, without inhibiting the skating action. It is ready for use whenever the skater wishes to stretch the in-line skate guard 2 over the toe 18, wheels 16, and heel of the in-line skate 4.

Figure 6:
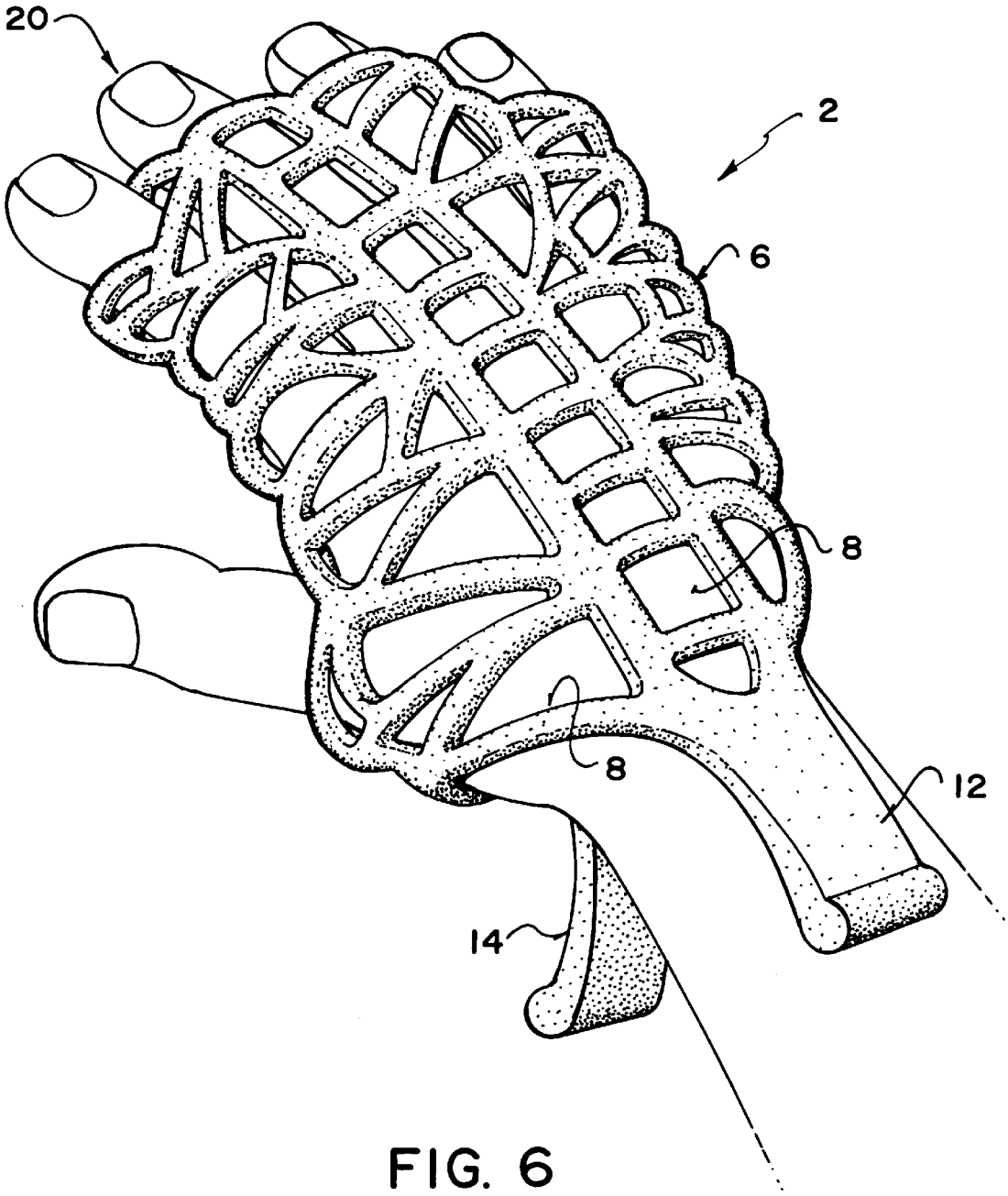
FIG. 6 illustrates an isometric view of an in-line skate guard worn on a hand of a skater when the in-line skate guard is not being used on an in-line skate.

FIG. 6 illustrates an isometric view of an in-line skate guard 2 worn on a hand 20 of a skater when the in-line skate guard is not installed on an in-line skate 4. As seen in FIG. 6, the skate guard 2 is worn over the hand 20 of the skater, rather than around the ankles of the in-line skate 4 of the skater, as illustrated above in FIG. 5. Again, this is possible because the in-line skate guard 2 is constructed of a resilient material such as rubber, which will fit numerous shapes, including the ankle and hand of the skater. If the skater wishes to install the in-line skate guard 2 over the in-line skate 4, the skater simply removes the web 6 from the hand 20, using upper finger pull loop 12 and lower finger pull loop 14, and then pulls the web 6 over the in-line skate 4 as illustrated and discussed previously in association with FIGS. 2, 3 and 4.

The web 6 of the in-line skate guard 2 can be dyed or pigmented with any one or more attractive fashionable colours. A major advantage of the in-line skate guard 2 is that because the ankle, toe area, all four wheels and heel of the in-line skate 4 are covered when the web 6 is stretched over the in-line skate 4, as illustrated in FIG. 1, the wheels are fully immobilized and it is impossible for the wheels 16 to roll out of the skate guard 2.

While a web construction is shown in FIGS. 1 to 6, it will be understood that other materials such as stretchable fabrics, or textiles can be substituted so long as the objectives of the invention are met. The main objective is to be able to stretch the fabric or textile over the boot and wheels so as to immobilize the wheels. It is also helpful if the article can be compressed to fit into a pocket, or be held around the ankle or on the hand. A person skilled in the art will be able to select a suitable material from the wide selection of materials currently and widely available to perform the objectives of the invention.

Figure 7:
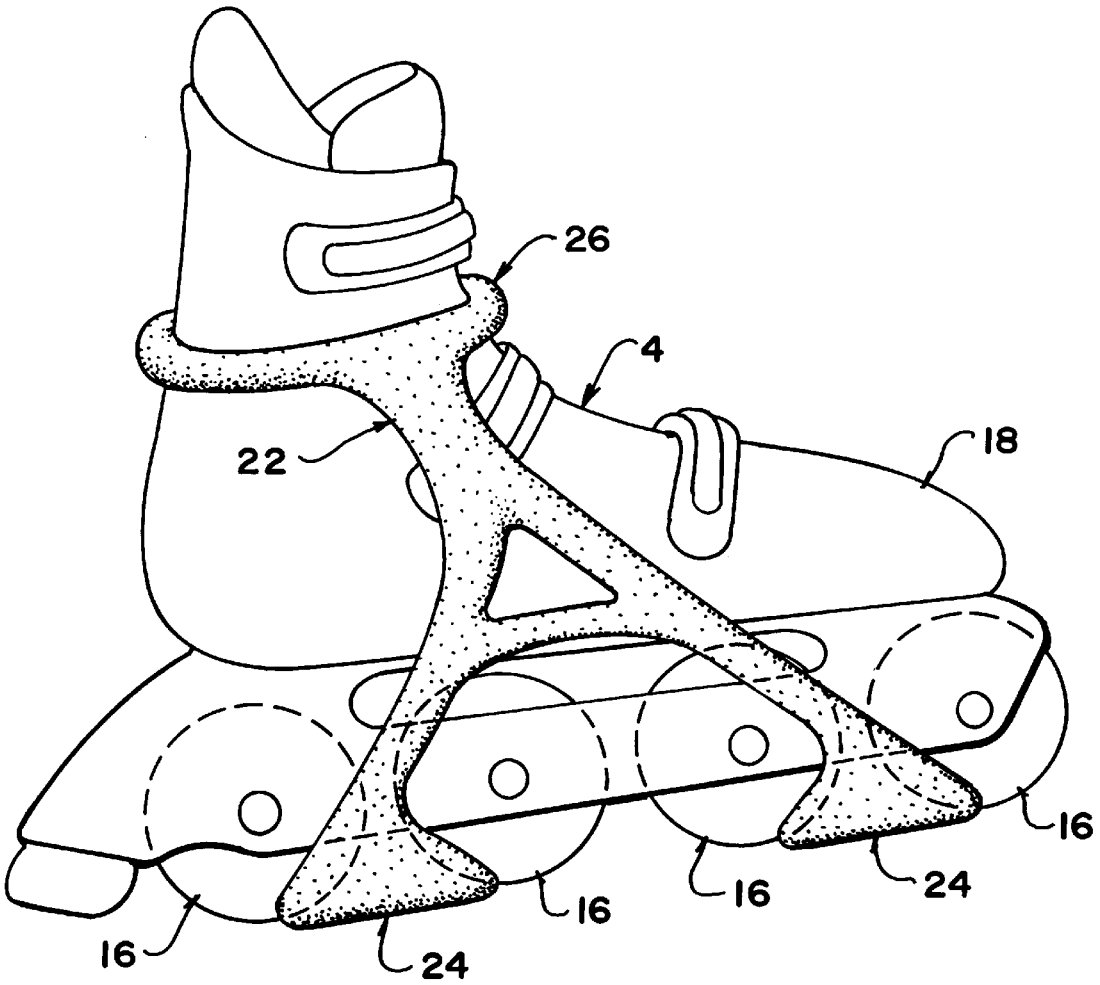
FIG. 7 illustrates an isometric view of a second embodiment of in-line skate guard which has an ankle holder loop, wheel wedges and a suspender system.

FIG. 7 illustrates an isometric view of a second embodiment of in-line skate guard which has an ankle holder loop, wheel wedges and a suspender system. As seen in FIG. 7, the second embodiment of in-line skate guard is constructed with a pair of wheel wedges 24, which are connected by elastic inverted "Y-shaped" suspenders 22 to the ankle of the in-line skate 4 and connected around the ankle by ankle holder loop 26. The ankle holder loop 26, and the suspenders 22 are formed of a highly resilient material so that the ankle holder loop 26 can be stretched around the boot to fit over the ankle of the boot 4. While not visible in FIG. 7, a corresponding resilient suspender 22 is fitted on the opposite side of the in-line skate 4. The wheel wedges 24 are formed so that they fit snugly between the bottom areas of adjacent wheels 16 and abut the wheels 16 to prevent them from rotating.

Figure 8:
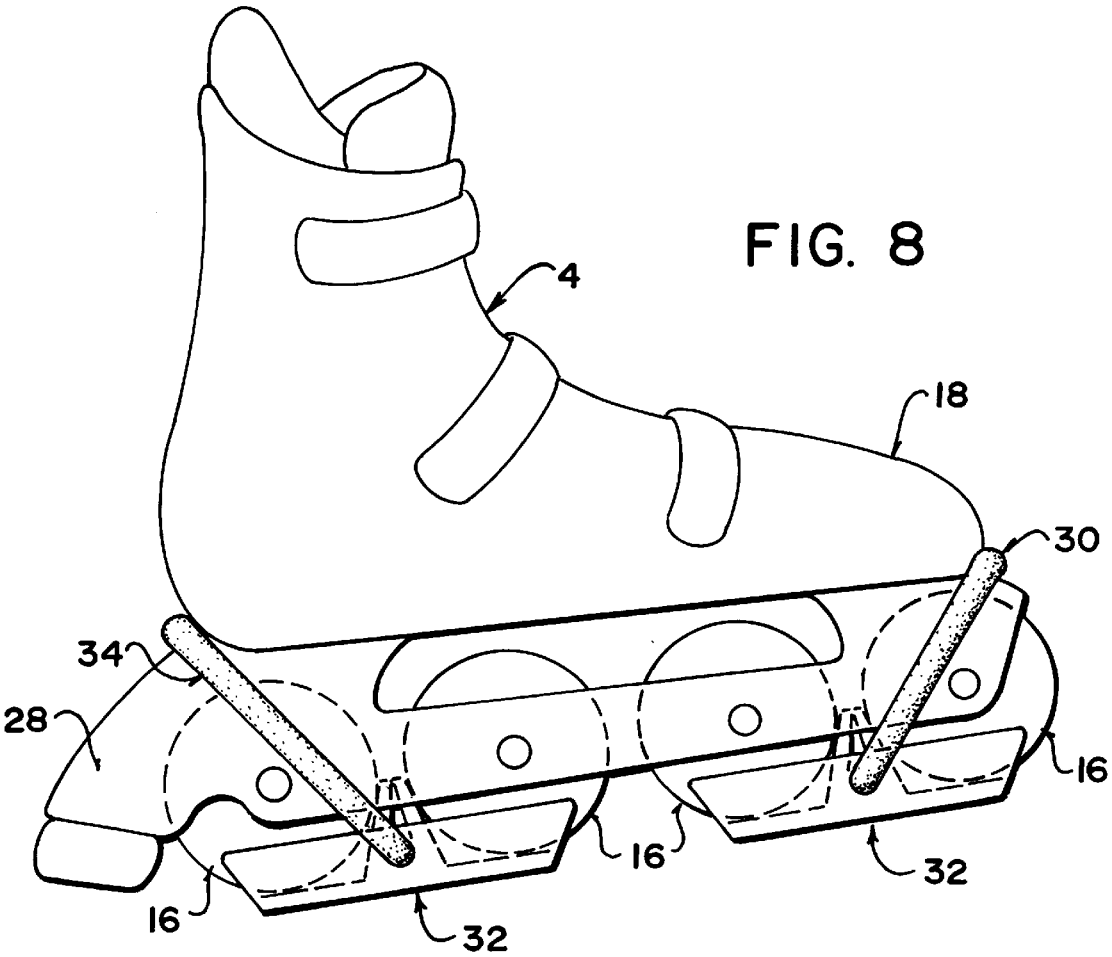
FIG. 8 illustrates an isometric view of a third embodiment of in-line skate guard constructed of a wheel lock and a toe or heel loop.

Alternative forms of the second embodiment of in-line skate guard are possible, for example, the ankle holder loop 26 can be formed so that it can be separated. In that case, it has a hook and pile fastener connection such as the type marketed under the trade-mark Velcro, for fastening the two parts together. This modification may be preferred rather than relying solely upon stretchability of the ankle holder 26 in order to fit it over the in-line skate 4. Also, buckles or bayonet-type connections can be used in place of a conventional hook and pile fastener, FIG. 8 illustrates an isometric view of a third embodiment of in-line skate guard constructed of a wheel lock and a toe or heel loop. As seen in FIG. 8, the third embodiment of in-line skate guard is formed of a wheel lock 32 which has a resilient toe loop 30, which stretches and fits over the top of the front housing of the front wheel 16.

As seen in FIG. 8, the rear wheel guard can be of an identical construction to the front wheel guard 30, 32. Thus, the skater does not have to carry different guards for the front and rear wheel locks. In the case of the rear wheel lock, the rear wheel lock 32 has a heel loop 34 which stretches over the top of the rear brake mount 28 at the rear of a conventional in-line skate 4.

Figure 9:
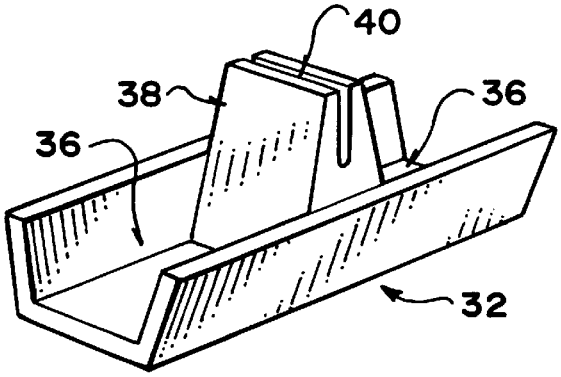
FIG. 9 illustrates an isometric view of the wheel lock.

FIG. 9 illustrates an isometric view of the wheel lock 32. As seen in FIG. 9, the wheel lock 32 is constructed so that it has a pair of wheel troughs 36 with an upright dual wheel wedge 38 formed in the mid-region thereof. The forward wheel trough 36 and the rear wheel trough 36 are adapted to fit snugly about adjacent wheel 16 of an in-line skate 4 and thereby prevent the adjacent wheels from rotating. Dual wheel wedge 38, which has a slot 40 therein, penetrates upwardly between the adjacent wheel 16 and impinges against the adjacent wheels 16. Specifically, the sloped side surfaces of the dual wheel wedge 38 are formed so that they impinge against the lower facing surfaces adjacent wheels 16 and thereby assist in preventing them from rotating. The slot 40 provides a certain amount of "give" in order to ensure that the wedge 38 impinges against the facing surfaces of adjacent wheels 16.

FIG. 10 illustrates a side partial section view of the wheel lock and heel loop of the in-line skate guard illustrated in FIG. 8. As seen in FIG. 10, the dual wheel wedge 38 penetrates upwardly between adjacent wheels 16 and bears snugly against them to prevent the wheels from rotating. The elastic heel loop 34 fits over the rear brake mount 28.

FIG. 11 illustrates an isometric view of a fourth embodiment of elastic wheel lock loop which can be used on both the heel and toe of an in-line skate. As seen in FIG. 11, the fourth embodiment of the in-line skate guard comprises a wheel lock wedge 44 which, when elastic wheel lock loop 42 is stretched upwardly over the top of the housing of the front wheel 16, rubs against the lower facing surfaces of adjacent wheels 16. The loop 42 is pulled upwardly by forward finger pull 46. Alternatively, or in addition (as seen in FIG. 11) , a second elastic wheel lock loop 42 is pulled upwardly by finger pull 46 to fit over rear brake mount 28. Adjacent wheels 16 at the rear of the in-line skate 4 are thereby prevented from rotating. An advantage of the embodiment of in-line skate guard that is illustrated in FIG. 11 is that the same elastic wheel lock loop 42 design can be used for both the toe and heel of the in-line skate 4. By having a similar design, the skater does not have to carry different designs of wheel lock loops 42, since the same design of loops 41 fit both the front and rear of the in-line skate.

Figure 12:
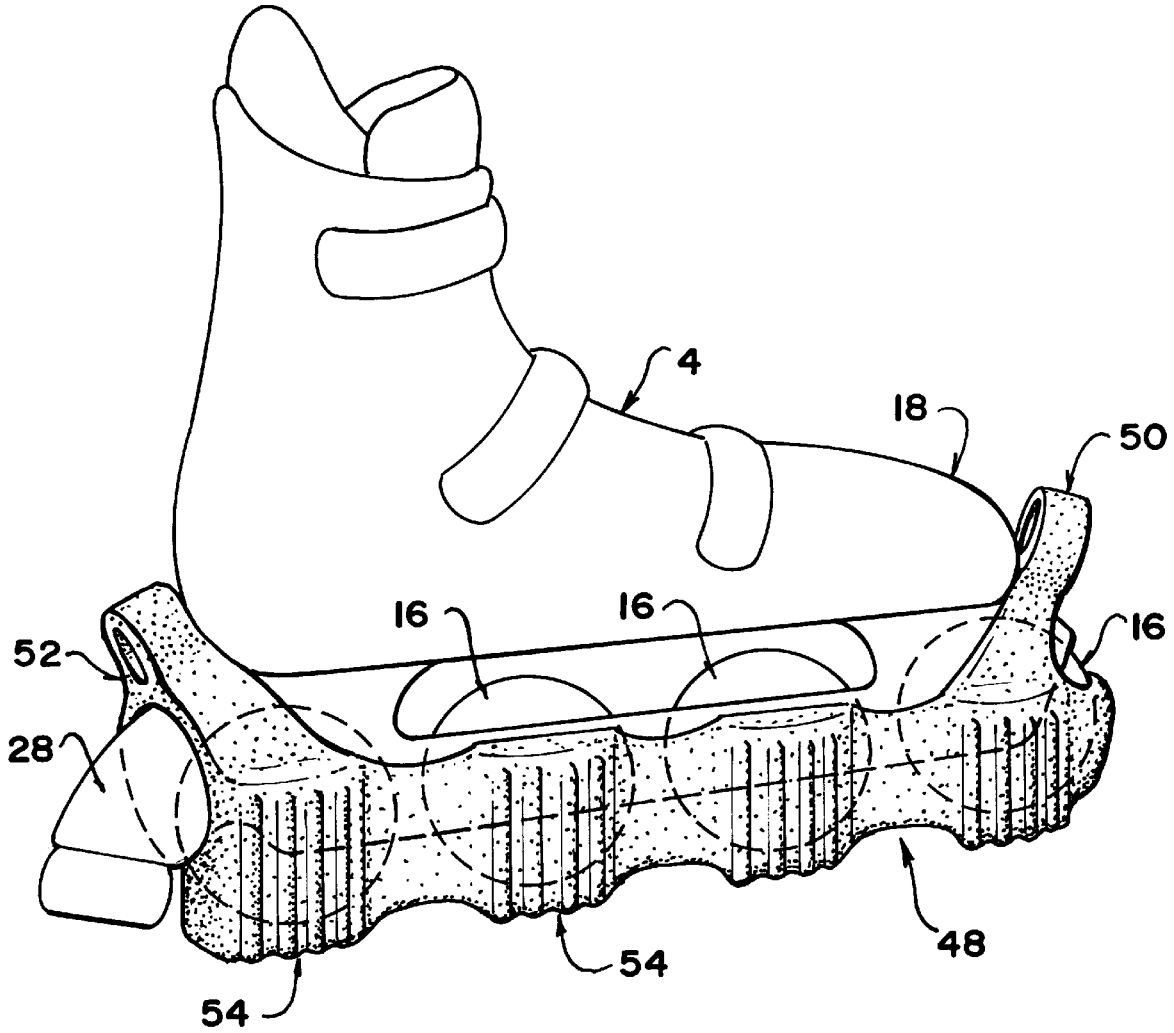
FIG. 12 illustrates an isometric view of a fifth embodiment of stretch-type in-line skate guard formed of a forward loop, a rear heel loop and individual wheel stops.

FIG. 12 illustrates an isometric view of a fifth embodiment of stretch-type in-line skate guard formed of a forward loop, a rear heel loop and individual wheel stops. As seen in FIG. 12, the fifth embodiment of in-line skate guard 48 is constructed of a highly resilient material and has a unitary construction. The stretch wheel lock 48 is constructed so that it has a forward loop 50 and a rear heel loop 52. The design of the stretch wheel lock 48 is symmetrical so that the skater need not be concerned with whether or not the forward or rear portion of the stretch wheel lock 48 is being used. The stretch wheel lock 48 illustrated in FIG. 12 includes four wheel stops 54, which are formed to fit over the bases and sides of the four wheels 16 of a conventional in-line skate 4. An advantage of the embodiment of in-line skate guard 48 that is illustrated in FIG. 12 is that the skater does not have to carry a number of skate guards. It is necessary only to carry two such skate guards 48, one for the left skate and the other for the right skate. The forward loop 50 and the rear heel loop 52 are formed of a highly stretchable material so that the stretch wheel lock 48 can be readily stretched over the base of the four wheels 16 of the in-line skate 4 and over the housing for the forward wheel 16, and the rear brake mount 28.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A wheel stop for use on an in-line skate having a series of wheels mounted in an in-line configuration on a wheel carriage secured underneath a boot having a toe portion and a rear portion, comprising:

(a) an abutment member which is capable of fitting between and abutting bottom facing areas of adjacent wheels of the in-line skate, and frictionally preventing said adjacent wheels from rotating; and (b) a stretchable tension member which has two opposite ends, said ends adapted to be attached to the abutment member at transversely opposite sides of the skate, and which said tension member is not capable of passing under the bottom facing areas of the in-line skate, and further said tension member is capable of fitting over a toe or heel area of the wheel carriage of the in-line skate, said tension member capable of holding the abutment member against the bottom facing areas of the adjacent wheels, and applying an upward force on the adjacent wheels, thereby preventing said wheels from rotating, and wherein the wheel stop is stretchable and collapsible and when installed immobilizes the wheels of the in-line skate.

2. A wheel stop as claimed in claim 1 wherein the tension member is made of resilient material and is in the shape of an inverted "Y", and the abutment members are a pair of wedge-like members that are connected to the ends of the forked stems of the inverted "Y", and a securing member is attached to the base of the stem of the inverted "Y" and is adapted to fit about an in-line skate and hold the pair of wedge-like members in position between adjacent wheels of the in-line skate.

3. A wheel stop as claimed in claim 1 wherein the abutment member is constructed with a pair of hollow trough-like depressions therein for accommodating a pair of adjacent wheels of the in-line skate and an upwardly-protruding wedge-like member for abutting the bottom facing areas of the in-line skate.

4. A wheel stop as claimed in claim 3 wherein the tension member is constructed in the form of a resilient loop for fitting over the forward or rearward portion of a wheel carriage of an in-line skate.

5. A wheel stop as claimed in claim 3 wherein the wedge-like member has a slot therein.

6. A wheel stop as claimed in claim 1 including a finger grip member secured to the tension member for enabling a skater to grip the tension member.

7. A wheel stop as claimed in claim 1 wherein the tension member comprises a forward resilient loop for fitting over the forward portion of the wheel carriage of an in-line skate, a second tension member comprises a resilient loop for fitting over the rearward portion of the wheel carriage of the in-line skate, and the abutment member comprises interconnected individual wheel abutment members, each of which is adapted to fit over the bottom facing areas and lower left and right and front and back areas of a wheel of the in-line skate and frictionally prevent the wheels from rotating.

8. A wheel stop as claimed in claim 1 wherein a pocket-shaped membrane comprises both the tension member and the abutment member, said pocket-shaped membrane having a plurality of openings therein, constructed of resilient material and shaped to be fittable over the boot and wheels of the in-line skate, and including members for enabling a person to pull the pocket-shaped membrane over an in-line skate.

9. A wheel stop as claimed in claim 8 wherein the number of openings in one area of the resilient membrane is greater than in another area of the membrane.

10. A wheel stop as claimed in claim 8 wherein the resilient membrane is constructed of a fabric.

11. A wheel stop as claimed in claim 8 wherein the means for pulling the membrane over the skate comprises an upper finger pull attached to one side of the pocket shaped membrane and a lower finger pull attached to the opposite side of the pocket-shaped membrane.

12. A wheel stop as claimed in claim 8 wherein the membrane is constructed of resilient rubber.

13. A wheel stop as claimed in claim 8 wherein the membrane is constructed of an elastomer.

14. A wheel stop as claimed in claim 8 wherein the pocket-shaped membrane, when in a stretched condition, forms a hollow envelope which is capable of accommodating the arch, toe, wheels and heel areas of the in-line skate.

* * * * *